US012668863B2

(12) United States Patent
Godin et al.

(10) Patent No.: US 12,668,863 B2
(45) Date of Patent: Jun. 30, 2026

(54) ALUMINUM-COPPER-LITHIUM ALLOY THIN SHEETS WITH IMPROVED TOUGHNESS, AND PROCESS FOR MANUFACTURING AN ALUMINUM-COPPER-LITHIUM ALLOY THIN SHEET

(71) Applicant: CONSTELLIUM ISSOIRE, Issoire (FR)

(72) Inventors: Helene Godin, La Buisse (FR); Erembert Nizery, Grenoble (FR)

(73) Assignee: CONSTELLIUM ROLLED PRODUCTS SINGEN GMBH & CO.KG, Singen (DE)

( * ) Notice: Subject to any disclaimer, the term of this patent is extended or adjusted under 35 U.S.C. 154(b) by 722 days.

(21) Appl. No.: 17/778,179

(22) PCT Filed: Nov. 30, 2020

(86) PCT No.: PCT/FR2020/052226

§ 371 (c)(1),
(2) Date: May 19, 2022

(87) PCT Pub. No.: WO2021/111069

PCT Pub. Date: Jun. 10, 2021

(65) Prior Publication Data

US 2022/0349040 A1 Nov. 3, 2022

(30) Foreign Application Priority Data

Dec. 6, 2019 (FR) ..... 1913889

(51) Int. Cl.
*C22F 1/057* (2006.01)
*B21B 3/00* (2006.01)
(Continued)

(52) U.S. Cl.
CPC ..... *C22F 1/057* (2013.01); *B21B 3/00* (2013.01); *C22C 21/14* (2013.01); *C22C 21/16* (2013.01);
(Continued)

(58) Field of Classification Search
CPC ..... C22F 1/057; B21B 3/00; B21B 2003/001; C22C 21/14; C22C 21/16; C22C 21/18
See application file for complete search history.

(56) References Cited

U.S. PATENT DOCUMENTS 4,806,174 A * 2/1989 Cho ..... C22F 1/04 148/438
4,816,087 A * 3/1989 Cho ..... C22F 1/04 148/692
(Continued)

FOREIGN PATENT DOCUMENTS

EP 1891247 A1 2/2008
EP 1966402 A1 9/2008
(Continued)

OTHER PUBLICATIONS

Elwin Rooy, Aluminum Alloy Ingot Casting and Continuous Processes, 2008, ASM Handbook, vol. 15, pp. 1001-1008 (Year: 2008).*
(Continued)

*Primary Examiner* — Christina A Johnson
(74) *Attorney, Agent, or Firm* — McBee Moore & Vanik IP, LLC

(57) ABSTRACT

The invention relates to a method for manufacturing a thin sheet made from aluminum-based alloy comprising, as % by weight, 2.2 to 2.7% Cu, 1.3 to 1.6% Li, less than 0.1% Ag, 0.2 to 0.5% Mg, 0.1 to 0.5% Mn, 0.01 to 0.15% Ti, a quantity of Zn of less than 0.3, a quantity of Fe and of Si of less than or equal to 0.1% each, and unavoidable impurities
(Continued)

with a content of less than or equal to 0.05% by weight each and 0.15% by weight in total, the remainder aluminum, wherein optionally the hot-rolling input temperature being between 400° C. and 460° C. and the hot-rolling output temperature being less than 300° C. and the mean heating speed during the solution heat treatment is at least approximately 17° C./min between 300° C. and 400° C., aging conditions such that the yield strength in the long-transverse direction Rp0.2 is between 350 and 380 MPa.

13 Claims, 6 Drawing Sheets

(51) Int. Cl.
*C22C 21/14* (2006.01)
*C22C 21/16* (2006.01)
*C22C 21/18* (2006.01)

(52) U.S. Cl.
CPC ..... *C22C 21/18* (2013.01); *B21B 2003/001* (2013.01)

(56) References Cited

U.S. PATENT DOCUMENTS

| | | | | |
|---|---|---|---|---|
| 10,501,835 | B2 | 12/2019 | Bes et al. | |
| 10,836,464 | B2 | 11/2020 | Bayona-Carrillo | |
| 2004/0094249 | A1* | 5/2004 | Uchida | C30B 29/02 148/415 |
| 2013/0092294 | A1* | 4/2013 | Eberl | C22C 21/16 148/552 |
| 2016/0053357 | A1 | 2/2016 | Bes et al. | |
| 2016/0060741 | A1 | 3/2016 | Chevy et al. | |
| 2016/0368589 | A1 | 12/2016 | Bayona-Carrillo | |
| 2021/0016869 | A1 | 1/2021 | Bayona-Carrillo | |
| 2021/0071285 | A1 | 3/2021 | Lorenzino | |
| 2021/0363623 | A1 | 11/2021 | Lorenzino | |

FOREIGN PATENT DOCUMENTS

| | | | |
|---|---|---|---|
| EP | 2981631 | A1 | 2/2016 |
| EP | 2981632 | A1 | 2/2016 |
| FR | 3014448 | A1 | 6/2015 |
| WO | 2019/122639 | A1 | 6/2019 |
| WO | 2019/234326 | A1 | 12/2019 |

OTHER PUBLICATIONS

International Search Report of International Application No. PCT/FR2020/052226, mailed Mar. 19, 2021.

Magnusen et al., "Development of high toughness sheet and extruded products for airplane fuselage structures", 13th International Conference on Aluminunn Alloys, TMS (The Minerals, Metals & Materials Society), 2012, pp. 535-540.

* cited by examiner

ALUMINUM-COPPER-LITHIUM ALLOY THIN SHEETS WITH IMPROVED TOUGHNESS, AND PROCESS FOR MANUFACTURING AN ALUMINUM-COPPER-LITHIUM ALLOY THIN SHEET

CROSS-REFERENCE TO RELATED APPLICATIONS

This application is the National Stage entry of International Application No. PCT/FR2020/052226, filed 30 Nov. 2020, which claims priority to French Application No. 1913889, filed 6 Dec. 2019.

BACKGROUND

Field

TECHNICAL FIELD

The invention relates to rolled metal sheets with thicknesses of less than 12.7 mm made from aluminum-copper-lithium alloys, offering improved toughness, and methods for manufacturing the same. These sheets are intended in particular for aeronautical and aerospace construction.

DESCRIPTION OF RELATED ART

Laminated products made from aluminum alloy are developed for producing fuselage elements intended in particular for the aeronautical industry and for the aerospace industry. Aluminum-copper-lithium alloys are particularly promising for manufacturing this type of product.

The patent EP 1 966 402 describes an alloy comprising 2.1 to 2.8% by weight Cu, 1.1 to 1.7% by weight Li, 0.1 to 0.8% by weight Ag, 0.2 to 0.6% by weight Mg, 0.2 to 0.6% by weight Mn, a quantity of Fe and of Si less than or equal to 0.1% by weight each, and unavoidable impurities with a content of less than equal to 0.05% by weight each and 0.15% by weight in total, the alloy being substantially free from zirconium, particularly adapted for obtaining recrystallized thin sheets.

The patent FR 3014448 describes a rolled and/or forged product the thickness of which is between 14 and 100 mm, made from aluminum alloy with a composition, as % by weight, Cu: 1.8-2.6, Li: 1.3-1.8, Mg: 0.1-0.5, Mn: 0.1-0.5 and Zr <0.05 or Mn <0.05 and Zr 0.10-0.16, Ag: 0-0.5, Zn <0.20, Ti: 0.01-0.15, Fe: <0.1, Si: <0.1, 15 other elements <0.05 each and <0.15 in total, the remainder aluminum, the density of which is less than 2.670 g/cm$^3$, characterized in that at mid-thickness the volume fraction of the grains having a brass texture is between 25 and 40% and the texture index is between 12 and 18.

The patent EP 2,981,632 describes a method for manufacturing a thin sheet with a thickness of 0.5 to 3.3 mm with an essentially non-recrystallized structure made from aluminum-based alloy wherein, successively, a) a bath of liquid metal is produced comprising 2.6 to 3.4% by weight Cu, 0.5 to 1.1% by weight Li, 0.1 to 0.4% by weight Ag, 0.2 to 0.8% by weight Mg, 0.11 to 0.20% by weight Zr, 0.01 to 0.15% by weight Ti, optionally at least one element selected from Mn, V, Cr, Sc, and Hf, the quantity of the element, if selected, being from 0.01 to 0.8% by weight for Mn, 0.05 to 0.2% by weight for V, 0.05 to 0.3% by weight for Cr, 0.02 to 0.3% by weight for Sc, 0.05 to 0.5% by weight for Hf, a quantity of Zn less than 0.6% by weight, a quantity of Fe and Si less than or equal to 0.1% by weight each, and unavoidable impurities with a content of less than or equal to 0.05% by weight each and 0.15% by weight in total; b) a slab is cast from said bath of liquid metal; c) said slab is homogenized at a temperature of between 450° C. and 515° C.; d) said slab is rolled by hot rolling into a sheet having a thickness of between 4 and 12 mm; e) said sheet is rolled by cold rolling into a thin sheet having a final thickness of between 0.5 and 3.3 mm, the reduction in thickness achieved by cold rolling being between 1 and 3.5 mm; f) a heat treatment is implemented during which the sheet reaches, during at least thirty minutes, a temperature of between 300° C. and 450° C.; g) solution heat treatment is carried out at a temperature of between 450° C. and 515° C. and said thin sheet is quenched; h) said sheet is stretched in a controlled manner with a permanent deformation of 0.5 to 5%, the cold deformation after solution heat treatment being less than 15%; i) aging is implemented, comprising heating at a temperature of between 130 and 170° C. and preferably between 150 and 160° C. from 5 to 100 hours and preferably 10 to 40 h.

The patent EP2981631 describes a sheet with a thickness of 0.5 to 8 mm made from aluminum-based alloy comprising 2.6 to 3.0% by weight Cu, 0.5 to 0.8% by weight Li, 0.1 to 0.4% by weight Ag, 0.2 to 0.7% by weight Mg, 0.06 to 0.20% by weight Zr, 0.01 to 0.15% by weight Ti, optionally at least one element selected from Mn, V, Cr, Sc, and Hf, the quantity of the element, if selected, being from 0.01 to 0.8% by weight for Mn, 0.05 to 0.2% by weight for V, 0.05 to 0.3% by weight for Cr, 0.02 to 0.3% by weight for Sc, 0.05 to 0.5% by weight for Hf, a quantity of Zn of less than 0.2% by weight, a quantity of Fe and Si of less than or equal to 0.1% by weight each, and unavoidable impurities with a content of less than or equal to 0.05% by weight each and 0.15% by weight in total, said sheet being obtained by a method comprising casting, homogenization, hot rolling and optionally cold rolling, solution heat treatment, quenching and aging, the composition and the aging being combined so that the yield strength in the longitudinal direction Rp0.2(L) is between 395 and 435 MPa.

For some fuselage applications, it is particularly important that the toughness is high in the T-L direction. This is because a major part of the fuselage is sized for withstanding the internal pressure of the aircraft. The longitudinal direction of the sheets being in general positioned in the direction of the length of the aircraft, these are stressed in the transverse direction by the pressure. The cracks are then stressed in the T-L direction.

It is known from the patent EP 1 891 247 that, for the sheets the thickness of which is between 4 and 12 mm, it may be advantageous for the microstructure to be completely non-recrystallized or completely recrystallized.

The application PCT/FR2019/051269 describes a method for manufacturing a thin sheet made from aluminum-based alloy comprising, as % by weight, 2.3 to 2.7% Cu, 1.3 to 1.6% Li, 0.2 to 0.5% Mg, 0.1 to 0.5% Mn, 0.01 to 0.15% Ti, a quantity of Zn of less than 0.3, a quantity of Fe and of Si of less than or equal to 0.1% each, and unavoidable impurities with a content of less than or equal to 0.05% by weight each and 0.15% by weight in total, wherein in particular the hot-rolling input temperature being between 400° C. and 445° C. and the hot rolling output temperature being less than 300° C. In this application, it is particularly advantageous to consider a thin sheet obtained by the method described wherein the mean grain size in the thickness measured by the intercepts method on an L/TC section in the direction L in accordance with ASTM E112 and expressed in um is less than 66+200, where t is the thickness of the sheet expressed in mm.

The inventors realized that this type of product did not make it possible to achieve a Kr60 toughness value greater than 190 MPa·$m^{1/2}$ or a $K_{app}$ toughness greater than 145 MPa·$m^{1/2}$, measured on test pieces of the CCT760 type (2a0=253 mm) in the T-L direction.

There is a need for thin sheets with a thickness of between 0.5 mm and 12.7 mm, made from aluminum-copper-lithium alloy having improved properties compared with those of the known products, in particular in terms of toughness in the T-L direction, properties of static mechanical strength and corrosion resistance, while having low density, low anisotropy of the mechanical properties and good resistance to aging. Moreover, there is a need for a simple and economical method for obtaining such thin sheets.

The object of the invention proposes to solve this problem.

SUMMARY

The first object of the invention relates to a method for manufacturing a sheet with a thickness of between 0.5 and 12.7 mm made from aluminum-based alloy wherein, successively, a) a liquid metal bath is produced comprising
2.2 to 2.7% by weight Cu,
1.3 to 1.6% by weight Li,
no more than 0.1% by weight Ag,
0.2 to 0.5% by weight Mg,
0.1 to 0.5% by weight Mn,
0.01 to 0.15% by weight Ti,
a quantity of Zn of less than or equal to 0.3% by weight, a quantity of Fe and of Si of less than or equal to 0.1% by weight each, the remainder being aluminum and unavoidable impurities with a content of less than or equal to 0.05% by weight each, and 0.15% by weight in total, the remainder aluminum, b) a slab is cast from said liquid-metal bath;

c) said slab is homogenized at a temperature of between 490° C. and 535° C.;

d) said homogenized slab is rolled by hot rolling and optionally by cold rolling into a sheet having a thickness of between 0.5 and 12.7 mm, the hot-rolling input temperature being between 400° C. and 460° C. and the hot-rolling output temperature being less than 300° C., preferably less than 290° C.;

e) said sheet is solution heat treated at a temperature of between 450° C. and 535° C. for at least 5 min, preferably at least 10 min, with a mean rate of heating of said sheet of at least approximately 17° C./min between 300° C. and 400° C., and said solution heat treated sheet is quenched in water;

f) said quenched sheet is stretched in a controlled manner with a permanent deformation of 0.5 to 6%, the cold deformation after solution heat treatment being less than 15%;

g) aging is implemented comprising heating at a temperature of between 130 and 170° C. and the duration being combined with the composition so that the yield strength in the long-transverse direction Rp0.2 (LT) is between 350 and 380 MPa, preferentially between 350 MPa and 370 MPa, even more preferentially between 355 and 365 MPa.

A second object of the invention relates to a thin sheet obtained by the method according to the first object of the invention, characterized by a mean grain size in the thickness measured by the intercepts method on an L/TC section in the L direction in accordance with ASTM E112 and expressed in um that is less than 56+250, where t is the thickness of the sheet expressed in mm, an Rp0.2 yield strength in the long-transverseLT direction of between 350 MPa and 380 MPa, preferably between 350 MPa and 370 MPa, and even more preferentially between 355 MPa and 365 MPa, and a $K_{app}$ plane stress toughness, measured on test pieces of the CCT760 type (2ao=253 mm), of at least 145 MPa·$m^{1/2}$ in the T-L direction.

A third object of the invention relates to the use of a thin sheet according to the second object of the invention in a fuselage panel for an aircraft.

BRIEF DESCRIPTION OF THE DRAWINGS

FIG. 1 shows the relationship between the yield strength in the LT direction and the stress intensity factor $K_{app}$ T-L measured on test pieces of the CCT760 type (2ao=253 mm) for the sheets of example 1.

FIG. 2 shows the relationship between the grain size measurements in the L direction according to the thicknesses of the sheets transformed in example 1.

FIG. 3 shows an example of a granular structure of example C-2-28 that corresponds to a reference example of example 1.

FIG. 4 shows an example of a granular structure of example A-2-25 that corresponds to an example according to the invention of example 1.

FIG. 5 shows an example of a granular structure of the example E-1-48 that corresponds to an example according to the invention of example 1.

FIG. 6 shows the effect of an aging of 1000 h at 85° C. on the yield strength in the LT direction and a stress intensity factor $K_{app}$ T-L measured on test pieces of the CCT760 type (2ao=253 mm) for the sheets of example 2.

DETAILED DESCRIPTION OF A PREFERRED EMBODIMENT

Figure 1:
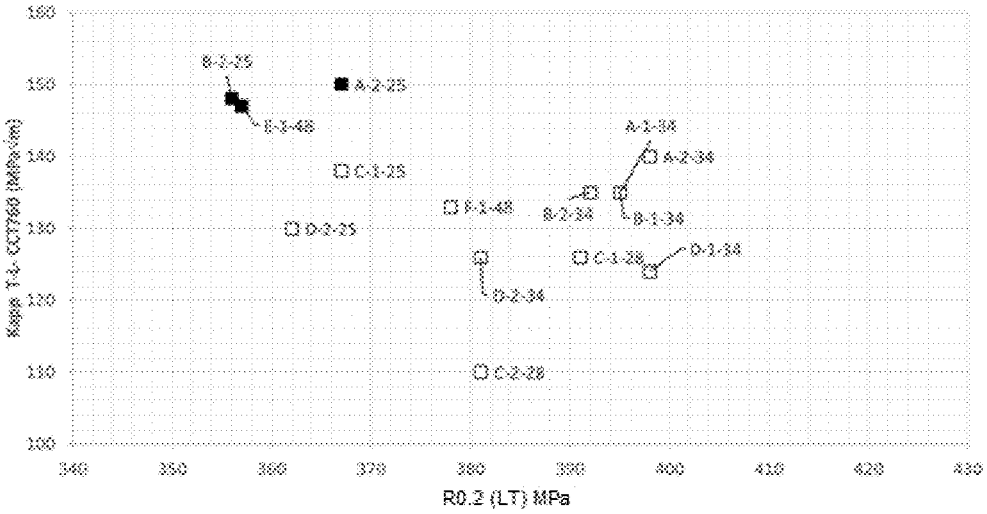
FIGS. 1-6 depict embodiments as described herein.

Unless mentioned to the contrary, all the indications relating to the chemical composition of the alloys are expressed as a percentage by weight based on the total weight of the alloy. The expression 1.4 Cu means that the copper content expressed as % by weight is multiplied by 1.4. The alloys are designated in conformity with the rules of the Aluminum Association, known to a person skilled in the art. The density is dependent on the composition and is determined by calculation rather than by a weight measurement method. The values are calculated in conformity with the procedure of the Aluminum Association, which is described on pages 2-12 and 2-13 of "Aluminum Standards and Data". Unless mentioned to the contrary, the definitions of the metallurgical states indicated in the European standard EN 515 (1993) apply.

The tensile static mechanical characteristics, in other words the ultimate tensile strength Rm, the conventional yield strength at 0.2% elongation Rp0.2, and the elongation at rupture A%, are determined by a tensile test in accordance with NF EN ISO 6892-1 (2016), the sampling and the direction of the test being defined by EN 485-1 (2016).

In the context of the invention, the mechanical characteristics are measured in full thickness. A curve giving the effective stress intensity factor according to the effective crack extension, known as the R curve, is determined in accordance with ASTM E 561. The critical stress intensity factor KC, in other words the intensity factor that makes the crack unstable, is calculated from the R curve. The stress intensity factor KCO is also calculated by attributing the initial crack length at the commencement of the monotonic load, to the critical load. These two values are calculated for a test piece of the required form. $K_{app}$ represents the KCO factor corresponding to the test piece that was used for implementing the R curve test. $K_{app}$ represents the KC factor corresponding to the test piece that was used for implementing the R curve test. KR60 represents the stress intensity factor corresponding to the crack extension Δaeff=60 mm. Δaeff(max) represents the crack extension of the last point on the R curve, valid according to ASTM E561. The last point is obtained either at the moment of the abrupt rupture of the test piece, or optionally at the moment when the stress on the non-cracked ligament exceeds on average the yield strength of the material. Unless mentioned to the contrary, the crack size at the end of the fatigue pre-cracking plateau is W/3 for test pieces of the M(T) type, wherein W is the width of the test piece as defined in ASTM E561 (ASTM E561-10-2).

Unless mentioned to the contrary, the definitions in EN 12258 (2012) apply.

In the context of the present invention, essentially recrystallized granular structure means a granular structure such that the degree of recrystallization at mid-thickness is greater than 70% and preferably greater than 90%. The degree of recrystallization is defined as the proportion of surface on a metallographic section occupied by recrystallized grains.

In the context of the present invention, a characteristic specified by a value preceded by the term "approximately" signifies that this characteristic may be between +/−10% of the value disclosed.

In the context of the present invention, thin sheet means a sheet with a thickness of between 0.5 mm and 12.7 mm.

The present inventors have obtained thin sheets, preferably between 0.5 and 8 mm, and even more preferentially between 1.2 mm and 6.5 mm, having an advantageous compromise between mechanical strength and toughness, using the method according to the invention, which comprises in particular the combination of

- a narrow selection of the composition,
- a deformation by hot rolling under strictly controlled thermal conditions,
- a strictly controlled mean rate rise during the solution heat treatment,
- controlled aging conditions for achieving a predetermined range of yield strength values in the LT direction.

The thin sheets thus obtained have particularly advantageous properties, especially with regard to toughness in the T-L direction.

In the method according to the invention, a liquid metal bath is produced the composition of which is as follows:

- 2.2 to 2.7% by weight Cu,
- 1.3 to 1.6% by weight Li,
- no more than 0.1% by weight Ag,
- 0.2 to 0.5% by weight Mg,
- 0.1 to 0.5% by weight Mn,
- 0.01 to 0.15% by weight Ti,
- a quantity of Zn of less than or equal to 0.3% by weight, a quantity of Fe and of Si of less than or equal to 0.1% by weight each, the remainder being aluminum and unavoidable impurities with a content of less than or equal to 0.05% by weight each, and 0.15% by weight in total, the remainder aluminum.

The copper content of the products according to the invention is between 2.2 and 2.7% by weight. When the copper content is too high, a very high toughness value in the T-L direction cannot be achieved. When the copper content is too low, the minimum static mechanical characteristics are not achieved. In an advantageous embodiment of the invention the copper content is between 2.45% and 2.55% by weight in order to increase the toughness value in the T-L direction. In another embodiment, the copper content is preferably between 2.20 and 2.35% by weight in order to improve the resistance to aging. At these copper contents, it is possible to achieve the mechanical properties of R0.2 (LT) sought in a T8 state. Preferably, the Cu content is at least 2.25% by weight and preferentially at least 2.27% by weight. Preferably, the copper content is no more than 2.30% by weight. In an advantageous embodiment of the invention, the copper content is between 2.20 and 2.30% by weight and preferably between 2.25 and 2.30% by weight.

The lithium content of the products according to the invention is between 1.3 and 1.6% by weight. Advantageously, the lithium content is between 1.35 and 1.55% by weight and preferably between 1.40% and 1.50% by weight. A minimum lithium content of 1.35% by weight and preferably 1.40% by weight is advantageous. A maximum lithium content of 1.55% by weight and preferably 1.50% by weight is advantageous, in particular for improving the compromise between toughness and mechanical strength. Adding lithium can contribute to increasing the mechanical strength and toughness, an excessively high or excessively low content does not make it possible to obtain a very high toughness value in the T-L direction and/or a sufficient yield strength. Moreover, adding lithium makes it possible to reduce the density. Advantageously, the density of the products according to the invention is less than 2.65. The silver content of the products according to the invention is less than or equal to 0.1% by weight. Advantageously, the silver content is less than or equal to 0.05% by weight and even more preferably less than or equal to 0.01% by weight. When the silver content is too high, the product has an excessively high industrial cost. Reducing the silver content to contents below 0.1% by weight has an economic advantage.

The magnesium content of the products according to the invention is between 0.2 and 0.5% by weight and preferably between 0.25 and 0.45% by weight and preferably between 0.25 and 0.35% by weight. A minimum magnesium content of 0.25% by weight is advantageous. A maximum magnesium content of 0.45% by weight and preferably 0.40% by weight and preferentially 0.35% by weight or even 0.30% by weight is advantageous.

The manganese content is between 0.1 and 0.5% by weight, preferably between 0.2 and 0.4% by weight and preferentially between 0.25 and 0.35% by weight. A minimum manganese content of 0.2% by weight and preferably 0.25% by weight is advantageous. A maximum manganese content of 0.4% by weight and preferably 0.35% by weight or even 0.33% by weight is advantageous.

The titanium content is between 0.01 and 0.15% by weight. Adding titanium, optionally combined with boron and/or carbon, contributes to controlling the granular structure, in particular during casting.

Preferably, the iron and silicon contents are each no more than 0.1% by weight. In an advantageous embodiment, the iron and silicon contents are no more than 0.08% and preferentially no more than 0.04% by weight. A controlled and limited iron and silicon content contributes to improving the compromise between mechanical strength and damage tolerance. The zinc content is less than or equal to 0.3% by weight, preferentially less than 0.2% by weight and preferably less than 0.1% by weight. The zinc content is advantageously less than 0.04% by weight.

The unavoidable impurities are maintained at a content of less than or equal to 0.05% by weight each and 0.15% by weight in total.

The method for manufacturing the thin sheets according to the invention next comprises steps of casting, homogenization, hot rolling and optionally cold rolling, solution heat treatment, controlled stretching, quenching and aging.

The liquid metal bath produced is cast in the form of a rolling slab.

The rolling slab is next homogenized at a temperature of between 490° C. and 535° C. Preferably, the duration of homogenization is between 5 and 60 hours. Advantageously, the homogenization temperature is at least 500° C. In one embodiment, the homogenization temperature is less than 515° C.

After homogenization, the rolling slab is in general cooled to ambient temperature before being preheated with a view to being deformed hot. The objective of the preheating is to reach a hot-rolling input temperature of between 400 and 460° C. and preferably between 420° C. and 445° C. and even more preferably between 420° C. and 440° C., allowing deformation by hot rolling.

The hot rolling is implemented so as to obtain a sheet with a thickness of typically 3 to 12.7 mm, preferentially 4 to 12.7 mm. The hot-rolling output temperature is less than 300° C. and preferably less than 290° C. in order to control the energy stored in the sheet. This makes it possible to obtain a grain size according to the invention if the rate rise conditions in solution heat treatment are also implemented according to the invention.

After hot rolling, it is possible optionally to cold roll the sheet obtained in particular to obtain a final thickness of between 0.5 and 4 mm.

There exists a range of thicknesses lying between 3 and 4 mm according to the invention where the product can be finished hot or cold.

Preferentially, the final thickness is no more than 8.0 mm, preferably no more than 7.0 mm and even more preferably no more than 6.5 mm. Advantageously, the final thickness is at least 0.8 mm and preferably at least 1.2 mm.

The sheet thus obtained is next solution heat treated between 450 and 535° C., preferentially between 450 and 525° C., for at least 5 min, preferably at least 10 min. The duration of solution heat treatment is advantageously between 5 min and 8 h, even more preferably between 10 min and 1 h. The mean speed of heating the sheet during the solution heat treatment must be at least approximately 17° C./min in the temperature range between 300° C. and 400° C., preferably at least approximately 19° C./min, and even more preferably at least approximately 25° C./min. It is important to control the hot-rolling output temperature in combination with the mean heating speed during the solution heat treatment. Controlling the mean speed of heating the sheet between 300° C. and 400° C. is necessary to control the final grain size of the product according to the invention. The mean speed of heating the sheet between 300° C. and 400° C. can be calculated by measuring the temperature-rise temperature of the sheet by means of a thermocouple placed on the surface of the sheet. The mean speed of heating the sheet between 300° C. and 400° C. is calculated by making a linear regression between 300° C. and 400° C. of the temperature of the metal according to the heating time for passing from 300° C. to 400° C. It is particularly important to control the mean heating speed between 300° C. and 400° C. It is well known to a person skilled in the art that the mean heating speed is influenced by the thermal conditions of the furnace (the temperature of the air inside the furnace, technology of the furnace), but also by the load (quantity and position of the sheets in the furnace) and the thickness of the product.

To control the speed, it is possible for example to treat a representative load of sheets to be produced in a furnace adapted for solution heat treatment and to monitor the temperature of these various sheets according to the parameters of the furnace. The temperature of the air in the furnace at the start of treatment and the set temperature profile are typical parameters for controlling the mean heating speed.

It is moreover known to a person skilled in the art that the precise solution heat treatment conditions, i.e. the duration and the temperature of the solution heat treatment maintenance plateau must be selected according to the thickness and the composition so as to solution heat treat the hardening elements.

The specific hot-rolling conditions in combination with the composition according to the invention and the speed of heating the sheet during the solution heat treatment make it possible in particular to obtain an advantageous compromise between mechanical strength, toughness and low anisotropy of the mechanical properties, as well as better resistance to aging.

The sheet thus solution heat treated is next quenched in water. Preferably, the quenching is done in water at ambient temperature.

The sheet next undergoes cold deformation by controlled stretching with a permanent deformation of 0.5 to 6% and preferentially 3 to 5%. Known steps such as rolling, flattening, straightening and shaping can optionally be implemented after solution heat treatment and quenching and before or after controlled stretching, however the total cold deformation after solution heat treatment and quenching must remain less than 15% and preferably less than 10%. High cold deformations after solution heat treatment and quenching in fact cause the appearance of numerous shear bands passing through several grains, these shear bands not being desirable. Preferably cold rolling is not implemented after solution heat treatment.

Aging is implemented, comprising heating at a temperature between 130 and 170° C. and preferably between 140 and 160° C. and preferably between 145 and 155° C. for 5 to 100 hours and preferably from 10 to 50 h in order to obtain a yield strength in the LT direction, R0.2 (LT), of between 350 MPa and 380 MPa, preferably between 350 MPa and 370 MPa, and even more preferably between 355 MPa and 365 MPa.

It is known to a person skilled in the art that, to determine the aging conditions making it possible to obtain a yield strength in the LT direction of between 350 MPa and 380 MPa, he can implement aging kinetics. Aging kinetics consists of cutting several blanks after solution heat treatment, quenching and cold deformation and evaluating the yield strength in the LT direction for various aging durations at a given temperature. It is thus possible to determine, for a given temperature, how the yield strength changes with the duration of aging and to select a duration of aging that makes it possible to obtain a yield strength of between 350 MPa and 380 MPa. Preferably, the final metallurgical state is a T8 state.

In one embodiment of the invention, a short heat treatment is implemented after controlled stretching and before aging so as to improve the formability of the sheets. The sheets can thus be shaped by a method such as drawing-forming before being aged. Examples of short heat treatments are described in the patents EP2766503 or EP 2984195. In this case, if a short treatment is implemented, the aging kinetics for determining the duration of aging necessary for achieving a yield strength in the LT direction, R0.2 (LT), of between 350 MPa and 380 MPa, must be implemented on blanks that have undergone this short treatment.

The thin sheets obtained by the method according to the invention have a characteristic grain size, preferably sheets with a thickness of between 0.8 and 8.0 mm, even more preferably between 1.2 mm and 6.5 mm. Thus the mean grain size in the thickness measured by the intercepts method on an L/TC section in the L direction according to ASTM E112 and expressed in μm is less than 56t+250, where t is the thickness of the sheet expressed in mm, preferably less than 56t+200 and preferably less than 56t+150.

The granular structure of the sheets is advantageously essentially recrystallized.

The thin sheets obtained by the method according to the invention have a particularly advantageous toughness in the T-L direction. In particular, the thin sheets obtained by the method according to the invention have a plane stress toughness $K_{app}$, measured on test pieces of the CCT760 type (2ao=253 mm) in the T-L direction, of at least 145 MPa·m$^{1/2}$, preferentially greater than 148 MPa·m$^{1/2}$and a yield strength in the LT direction of between 350 MPa and 380 MPa, preferentially between 350 MPa and 370 MPa and even more preferentially between 355 MPa and 365 MPa. Advantageously, the thin sheets obtained by the method according to the invention have a plane stress toughness $KR_{60}$, measured on test pieces of the CCT760 type (2ao=253 mm) in the T-L direction, of at least 190 MPa·m$^{1/2}$, preferentially at least 195 MPa·m$^{1/2}$. The thin sheets obtained by the method according to the invention have a mean grain size in the thickness measured by the intercepts method on an L/TC section in the L direction in accordance with ASTM E112 and expressed in um is less than 56t+250, where t is the thickness of the sheet expressed in mm, preferably less than 56t+200 and preferably less than 56t+150, an Rp0.2 yield strength in the LT direction of between 350 MPa and 380 MPa, preferentially 350 MPa and 370 MPa, even more preferentially 355 MPa and 365 MPa, and a $K_{app}$ plane stress toughness, measured on test pieces of the CCT760 type (2ao=253 mm), of at least 145 MPa·m$^{1/2}$ in the T-L direction.

In a preferred embodiment, favorable performances of the thin sheets according to the invention with regard to toughness, preferably for a thickness of between 1.2 mm and 6.5 mm, are obtained when the lithium content is between 1.40 and 1.50% by weight, the copper content is between 2.45 and 2.55% by weight and the magnesium content is between 0.25 and 0.35% by weight. The $K_{app}$ plane stress toughness, measured on test pieces of the CCT760 type (2ao=253 mm) is greater than 148 MPa·m$^{1/2}$, for a lithium content of between 1.40 and 1.50% by weight, a copper content of between 2.45 and 2.55% by weight and a magnesium content of between 0.25 and 0.35% by weight.

In another preferred embodiment, favorable performances of the thin sheets according to the invention, with regard to aging behavior, preferably for a thickness of between 1.2 mm and 6.5 mm, are obtained when the lithium content is between 1.40 and 1.50% by weight, the copper content is between 2.20 and 2.35% by weight, preferably between 2.20 and 2.30% by weight, and the magnesium content is between 0.25 and 0.35% by weight. The plane stress toughness $K_{app}$, measured on test pieces of the CCT760 type (2ao=253 mm) before and after aging of 1000 h at 85° C. is greater than 135 MPa·m$^{1/2}$, for a lithium content of between 1.40 and 1.50% by weight, a copper content of between 2.20 and 2.35% by weight and a magnesium content of between 0.25 and 0.35% by weight The intergranular corrosion resistance of the sheets according to the invention is high. In a preferred embodiment of the invention, the sheet of the invention can be used without flattening.

The use of thin sheets according to the invention in a fuselage panel for an aircraft is advantageous. The thin sheets according to the invention are also advantageous in the aerospace applications such as the manufacture of rockets.

EXAMPLE 1

In this example, six castings (A-F) were produced in the form of slabs. The proportions by weight % of the alloy elements are indicated in Table 1 below.

TABLE 1

| Composition | Cu | Li | Mg | Mn | Ti | Ag | Fe | Si | Zn |
|---|---|---|---|---|---|---|---|---|---|
| A | 2.51 | 1.43 | 0.28 | 0.30 | 0.03 | <0.01 | 0.04 | 0.03 | <0.01 |
| B | 2.36 | 1.54 | 0.26 | 0.30 | 0.04 | <0.01 | 0.04 | 0.03 | <0.01 |
| C | 2.52 | 1.46 | 0.35 | 0.36 | 0.04 | <0.01 | 0.04 | 0.03 | <0.01 |
| D | 2.59 | 1.46 | 0.34 | 0.36 | 0.04 | <0.01 | 0.04 | 0.02 | <0.01 |
| E | 2.27 | 1.41 | 0.28 | 0.29 | 0.03 | <0.01 | 0.04 | 0.03 | <0.01 |
| F | 2.39 | 1.43 | 0.31 | 0.30 | 0.03 | 0.1 | 0.04 | 0.03 | 0.2 |

The slabs were transformed in accordance with the parameters indicated in Table 2.

TABLE 2

| Transformation reference | Composition | Homogenization | Hot-rolling input temperature (° C.) | Hot-rolling output temperature (° C.) | Cold rolling | Final thickness (mm) | Speed of metal heating between 300 and 400° C. on solution heat treatment (° C./min) | Solution heat treatment | Stretching |
|---|---|---|---|---|---|---|---|---|---|
| A-1 | A | 12 h 505° C. | 434 | 250 | no | 6.4 | >50 | 40 min 500° C. | 4.1 to 4.5% |
| A-2 | A | 12 h 505° C. | 430 | 280 | no | 4 | 19 | 30 min 500° C. | 4.5 to 5.0% |

TABLE 2-continued

| Transformation reference | Composition | Homogenization | Hot-rolling input temperature (° C.) | Hot-rolling output temperature (° C.) | Cold rolling | Final thickness (mm) | Speed of metal heating between 300 and 400° C. on solution heat treatment (° C./min) | Solution heat treatment | Stretching |
|---|---|---|---|---|---|---|---|---|---|
| B-1 | B | 12 h 505° C. | 430 | 269 | yes | 1.6 | 27 | 10 min 500° C. | 4.5 to 4.9% |
| B-2 | B | 12 h 505° C. | 432 | 273 | no | 4 | 19 | 30 min 500° C. | 4.0 to 4.5% |
| C-1 | C | 12 h 505° C. | 452 | 313 | yes | 3.2 | 23 | 20 min 500° C. | 4.0 to 4.5% |
| C-2 | C | 12 h 505° C. | 451 | 338 | no | 6.4 | >50 | 40 min 500° C. | 4.1 to 4.3% |
| D-1 | D | 12 h 505° C. | 447 | 309 | yes | 2.2 | 14.5 | 20 min 500° C. | 3.8 to 4.6% |
| D-2 | D | 12 h 505° C. | 448 | 320 | no | 4 | 20 | 30 min 500° C. | 3.5 to 4.3% |
| E-1 | E | 12 h 505° C. | 423 | 300 | yes | 2 | 30 | 10 min 500° C. | 3.0 to 3.5% |
| F-1 | F | 12 h 505° C. | 434 | 288 | no | 4 | 10 | 30 min 500° C. | 3.0 to 3.5% |

At the end of these transformation steps, the sheets were aged. In some cases, several aging conditions were implemented, making it possible to achieve various values of R0.2 (LT) (see Table 3 and Table 4).

TABLE 3

| Sheet reference | Sheet that followed transformation | Aging implemented |
|---|---|---|
| A-1-34 | A-1 | 34 h 155° C. |
| A-2-25 | A-2 | 25 h 155° C. |
| A-2-34 | A-2 | 34 h 155° C. |
| B-1-34 | B-1 | 34 h 155° C. |
| B-2-25 | B-2 | 25 h 155° C. |
| B-2-34 | B-2 | 34 h 155° C. |
| C-1-25 | C-1 | 25 h 155° C. |
| C-1-28 | C-1 | 28 h 155° C. |
| C-2-28 | C-2 | 28 h 155° C. |
| D-1-34 | D-1 | 34 h 155° C. |
| D-2-25 | D-2 | 25 h 155° C. |
| D-2-34 | D-2 | 34 h 155° C. |
| E-1-48 | E-1 | 48 h 152° C. |
| F-1-48 | F-1 | 48 h 152° C. |

At the end of the aging, the samples were tested mechanically in order to determine the static mechanical properties thereof as well as the resistance to fatigue crack propagation thereof. The tensile yield strength (Rp0.2), the ultimate tensile strength (Rm) and the elongation at rupture (A) are supplied in Table 4. Table 6 summarizes the results of the toughness tests for these samples.

TABLE 4

| Sheet reference | $R_{p0.2}$ (L) MPa | $R_m$ (L) MPa | A % (L) % | $R_{p0.2}$ (LT) MPa | $R_m$ (LT) MPa | A % (LT) % | $R_{p0.2}$ (45°) MPa | $R_m$ (45°) MPa | A % (45°) % |
|---|---|---|---|---|---|---|---|---|---|
| A-1-34 | 415 | 444 | 12.2 | 395 | 445 | 12.6 | 393 | 439 | 13.1 |
| A-2-25 | | | | 367 | 425 | 13.2 | | | |
| A-2-34 | 414 | 439 | 13.3 | 398 | 447 | 12.7 | 398 | 440 | 13 |
| B-1-34 | 402 | 426 | 13 | 395 | 446 | 12.3 | 385 | 429 | 13.2 |
| B-2-25 | | | | 356 | 417 | 13.5 | | | |
| B-2-34 | 405 | 433 | 12.8 | 392 | 443 | 11.5 | 388 | 435 | 11.8 |
| C-1-25 | | | | 367 | 440 | 11.7 | | | |
| C-1-28 | 414 | 442 | 13.1 | 391 | 463 | 11.9 | 381 | 446 | 13.7 |
| C-2-28 | 401 | 435 | 13.6 | 381 | 450 | 10.2 | 374 | 437 | 13.7 |
| D-1-34 | 410 | 439 | 11 | 398 | 465 | 9.6 | 385 | 444 | 12.4 |
| D-2-25 | | | | 362 | 435 | 11.2 | | | |
| D-2-34 | 400 | 434 | 12.6 | 381 | 451 | 10 | 389 | 446 | 12.1 |
| E-1-48 | 374 | 408 | 13.6 | 357 | 419 | 13.3 | 342 | 402 | 11.2 |
| F-1-48 | 383 | 426 | 11 | 378 | 438 | 10.3 | 373 | 432 | 11.9 |

The results obtained are shown in FIG. 1.

Figure 2:
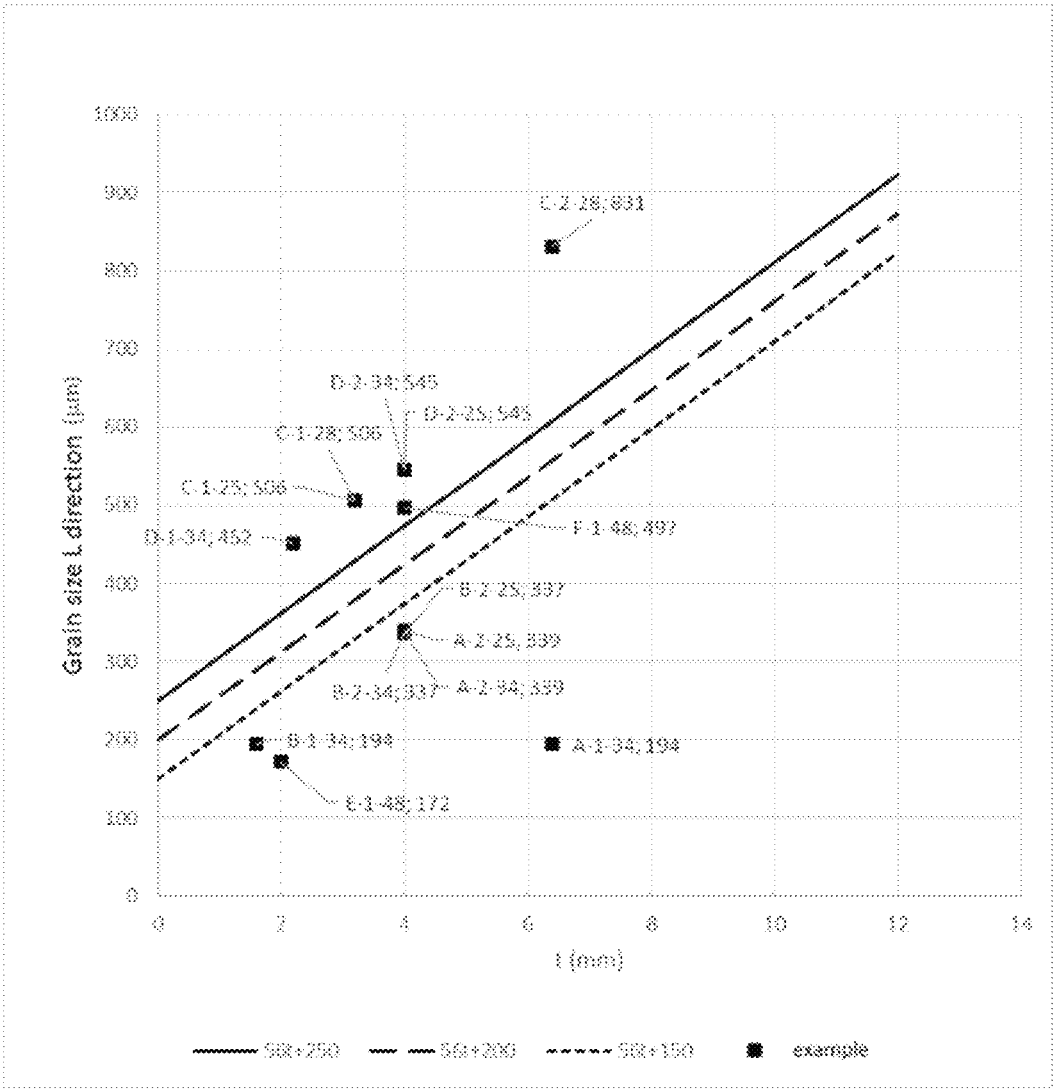
Figure 3:
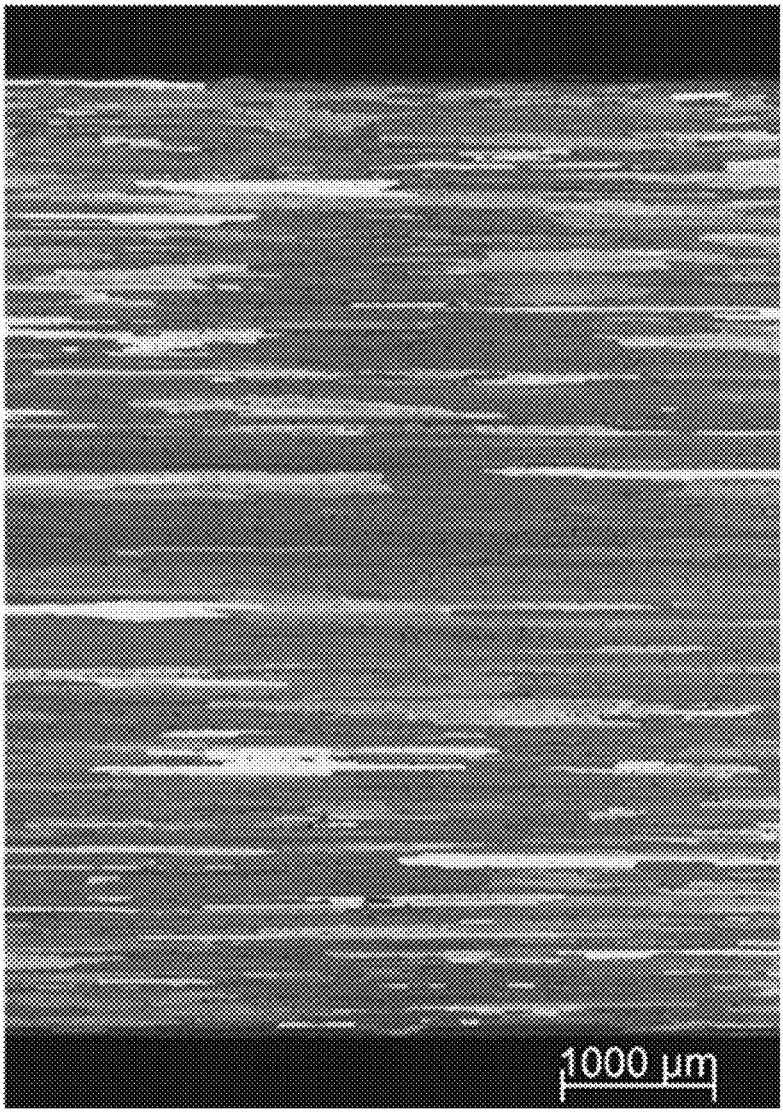
Figure 4:
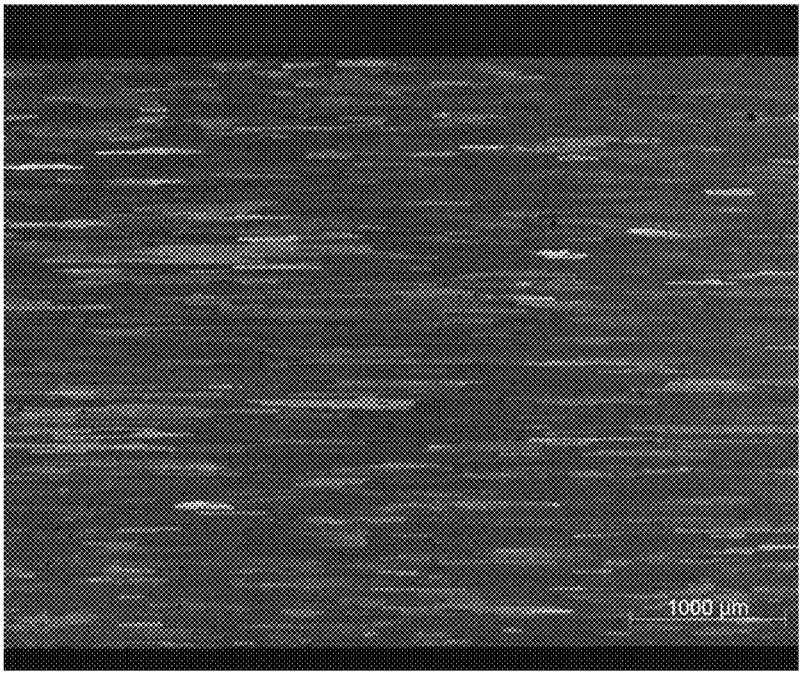
Figure 5:
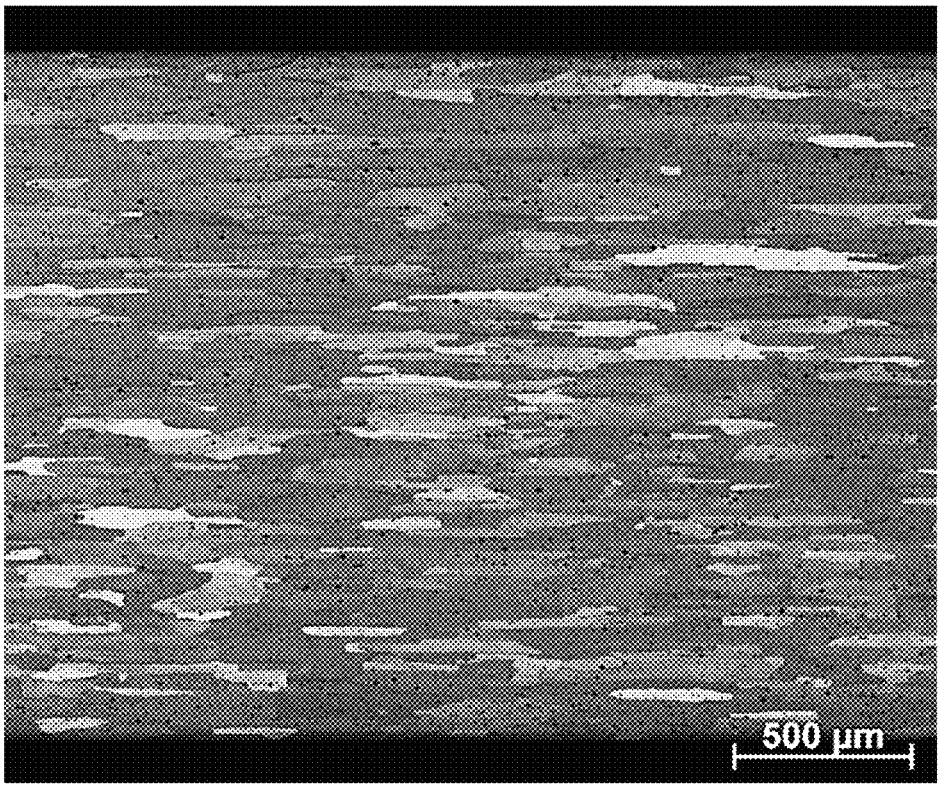

The granular structure of the samples was characterized from the microscopic observation of the cross sections after anodic oxidation, under polarized light on L/TC sections. The granular structure of the sheets was recrystallized. FIG. 3, FIG. 4 and FIG. 5 show the observed granular structures of the samples C-2-28, A-2-25 and E-1-48. The mean grain sizes in the thickness measured by the intercepts method in accordance with ASTM E112 are presented in Table 5. Typically, the granular structure is not affected by the aging conditions. It is therefore expected that the grain sizes will be identical whatever the aging conditions implemented for a given transformation condition. The measured grain sizes are shown in FIG. 2.

TABLE 5

| Sheet reference | Grain size L (μm) | Grain size TC (μm) | Aspect ratio L/TC | Grain size criterion < 56t + 250 verified 56t + 250 | Yes/No |
|---|---|---|---|---|---|
| A-1-34 | 194 | 28 | 7 | 608.4 | Yes |
| A-2-25 | 339 | 34 | 10 | 474 | Yes |
| A-2-34 | 339 | 34 | 10 | 474 | Yes |
| B-1-34 | 194 | 41 | 5 | 339.6 | Yes |
| B-2-25 | 337 | 31 | 11 | 474 | Yes |
| B-2-34 | 337 | 31 | 11 | 474 | Yes |
| C-1-25 | 506 | 45 | 11 | 429.2 | No |
| C-1-28 | 506 | 45 | 11 | 429.2 | No |
| C-2-28 | 831 | 45 | 19 | 608.4 | No |
| D-1-34 | 452 | 56 | 8 | 373.2 | No |
| D-2-25 | 545 | 47 | 12 | 474 | No |
| D-2-34 | 545 | 47 | 12 | 474 | No |
| E-1-48 | 172 | 39 | 4 | 362 | Yes |
| F-1-48 | 497 | 45 | 11 | 474 | No |

TABLE 6

| Sheet reference | $K_{app}$ T-L MPa · $m^{1/2}$ | $K_{app}$ L-T MPa · $m^{1/2}$ | Kr60 T-L MPa · $m^{1/2}$ | Kr60 L-T MPa · $m^{1/2}$ |
|---|---|---|---|---|
| A-1-34 | 135 | 161 | 181 | 213 |
| A-2-25 | 150 | | 199 | |
| A-2-34 | 140 | 168 | 187 | 222 |
| B-1-34 | 135 | 154 | 178 | 206 |
| B-2-25 | 148 | | 196 | |
| B-2-34 | 135 | 163 | 180 | 216 |
| C-1-25 | 138 | | 183 | |
| C-1-28 | 126 | 156 | 167 | 208 |
| C-2-28 | 110 | 157 | 142 | 208 |
| D-1-34 | 124 | 152 | 162 | 201 |
| D-2-25 | 130 | | 174 | |
| D-2-34 | 126 | 158 | 166 | 210 |
| E-1-48 | 147 | 156 | 195 | 207 |
| F-1-48 | 133 | 165 | 175 | 217 |

The references A-2-25, B-2-25 and E-1-48 are produced according to the invention.

Aiming solely at a yield strength R0.2 (LT) after aging lying between 350 MPa and 380 MPa does not make it possible to obtain a $K_{app}$ toughness value greater than 145 MPa·$m^{1/2}$ in the T-L direction if the grain size does not meet the criterion of the invention: grain size less than 56t +250, where t is the thickness of the sheet in question.

A grain size in the L direction of less than 56t+250 is in particular obtained if the hot-rolling output temperature is less than 300° C. and if the speed of heating of the metal between 300 and 400° C. during the solution heat treatment is greater than or equal to 17° C./min.

The example F-1-48 shows that, despite the hot-rolling conditions complying with an output temperature of less than 300° C. and aging conditions making it possible to achieve a value of R0.2 (LT) lying between 350 MPa and 380 MPa, this product does not make it possible to achieve a toughness value $K_{app}$ greater than 145 MPa·$m^{1/2}$ in the T-L direction. This is related to the fact that the speed of heating the metal between 300 and 400° C. during the solution heat treatment is less than approximately 17° C./min and the grain size in the L direction is greater than 56t+250.

Examples C-1-25 and D-2-25 show that, despite a speed of heating of the metal between 300 and 400° C. during the solution heat treatment of less than approximately 17° C./min and aging conditions making it possible to achieve a value of R0.2 (LT) lying between 350 MPa and 380 MPa, these products do not make it possible to achieve a $K_{app}$ toughness value greater than 145 MPa·$m^{1/2}$ in the T-L direction. This is related to the fact that the hot-rolling output temperature is not below 300° C. and consequently the grain size in the L direction is greater than 56t+250.

EXAMPLE 2

Figure 6:
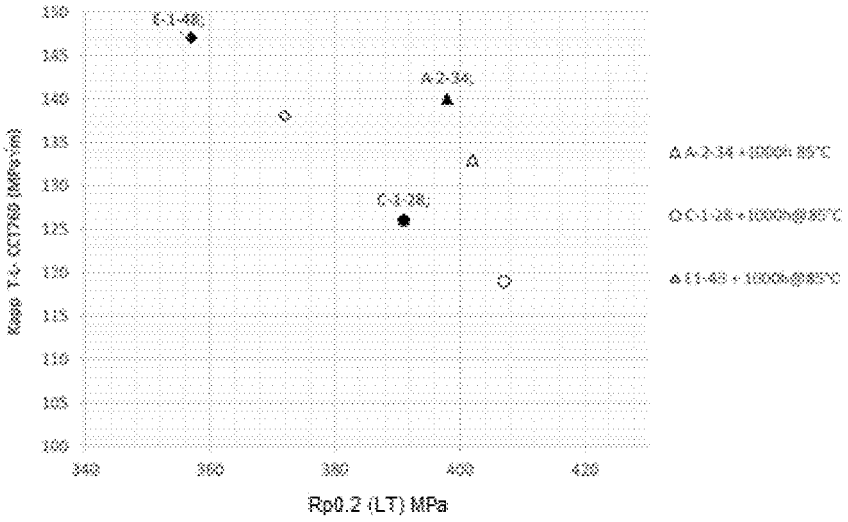

In this example, three sheets previously tested in the previous example: E-1-48 transformed according to the invention and two other sheets A-2-34 and C-1-28 as reference, were tested after aging at low temperature for 1000 h at 85° C. The yield strength of these products after 1000 h 85° C. aging and the toughness in the T-L direction are presented in Table 7 below and shown in FIG. 6.

TABLE 7

| Sheet reference | After aging R0.2 LT MPa | After aging $K_{app}$ T-L MPa · $m^{1/2}$ | After aging Kr60 T-L MPa · $m^{1/2}$ | After aging + 1000 h 85° C. R0.2 LT MPa | After aging + 1000 h 85° C. $K_{app}$ T-L MPa · $m^{1/2}$ | After aging + 1000 h 85° C. Kr60 T-L MPa · $m^{1/2}$ |
|---|---|---|---|---|---|---|
| E-1-48 | 357 | 147 | 195 | 372 | 138 | 184 |
| A-2-34 | 398 | 140 | 187 | 402 | 133 | 178 |
| C-1-28 | 391 | 126 | 167 | 421 | 102 | 134 |

The references A-1-34, A-2-34, B-1-34, B-2-34, C-1-28 are products outside the invention that were described in the application PCT/FR2019/051269. These products do not make it possible to achieve a $K_{app}$ toughness value greater than 145 MPa·$m^{1/2}$ in the T-L direction.

This is because, even if the examples A-1-34, A-2-34, B-1-34 and B-2-34 were rolled so that, at the discharge from the rolling, the temperature is less than 300° C. and have a grain size in the L direction that satisfies the criterion of the invention: grain size less than 56+250, these products do not make it possible to achieve a $K_{app}$ toughness value greater than 145 MPa·$m^{1/2}$ in the T-L direction since the value of R0.2 (LT) does not satisfy the criterion of the invention: R0.2 (LT) after aging lying between 350 MPa and 380 MPa.

The sheet E-1-48 obtained according to the invention shows after aging a toughness $K_{app}$ in the T-L direction greater than 135 MPa·$m^{1/2}$.

The invention claimed is:

1. A method for manufacturing a sheet with a thickness of between 4 and 12.7 mm made from aluminum-based alloy wherein, successively, a) producing a liquid metal bath consisting of 2.2 to 2.7% by weight Cu, 1.3 to 1.6% by weight Li, no more than 0.1% by weight Ag, 0.2 to 0.5% by weight Mg, 0.1 to 0.5% by weight Mn, 0.01 to 0.15% by weight Ti, a quantity of Zn of less than or equal to 0.3% by weight, a quantity of Fe and of Si of less than or equal to 0.1% by weight each, the remainder being aluminum and unavoidable impurities with a content of less than or equal to 0.05% by weight each, and 0.15% by weight in total, the remainder aluminum, b) casting a slab from said liquid-metal bath;

c) homogenizing said slab at a temperature of between 490° C. and 535 ° C.;

d) rolling said homogenized slab by hot rolling into a sheet having a thickness of between 4 and 12.7 mm, a hot-rolling input temperature being between 420° C. and 445° C. and a hot-rolling output temperature being less than 300° C.;

e) solution heat treating said sheet at a temperature of between 450° C. and 535° C. for at least 5 min, with a mean rate of heating of said sheet of at least 17° C./min between 300° C. and 400° C., and said solution heat treated sheet is quenched in water;

f) stretching said quenched sheet in a controlled manner with a permanent deformation of 0.5 to 6%, a cold deformation after solution heat treatment being less than 15%;

g) aging said sheet, said aging comprising heating at a temperature of between 130 and 170° C. so that yield strength in a long-transverse direction Rp0.2 (LT) is between 350 and 380 MPa, and wherein the sheet is recrystallized.

2. The method according to claim 1, wherein the copper content is between 2.45 and 2.55% by weight.

3. The method according to claim 1, wherein the lithium content is between 1.35 and 1.55% by weight.

4. The method according to claim 1, wherein the magnesium content is between 0.25 and 0.45% by weight.

5. The method according to claim 1, wherein the manganese content is between 0.2 and 0.4% by weight.

6. The method according to claim 1, wherein the zinc content is less than 0.1% by weight.

7. The method according to claim 1, wherein the silver content is less than 0.05% by weight.

8. The method according to claim 1, wherein hot-rolling input temperature is between 420° C. and 440° C. and/or hot-rolling output temperature is less than 290° C.

9. The method according to claim 1, wherein the copper content is between 2.20 and 2.35% by weight.

10. The method according to claim 1, wherein the Fe content and the Si content are no more than 0.08% by weight each.

11. The method according to claim 1, wherein the homogenization temperature is between 500° C. and 515° C.

12. The method according to claim 1, wherein the temperature of the solution heat treatment is between 450° C. and 525° C.

13. The method according to claim 1, wherein the aging comprising heating at a temperature of between 145 and 155° C.

* * * * *